US010145618B2

(12) United States Patent
Stuart

(10) Patent No.: US 10,145,618 B2
(45) Date of Patent: Dec. 4, 2018

(54) PORTABLE HEAT TREATMENT APPARATUS

(71) Applicant: Daniel Stuart, Damascus, MD (US)

(72) Inventor: Daniel Stuart, Damascus, MD (US)

(73) Assignee: Daniel Stuart, Damascus, MD (US)

( * ) Notice: Subject to any disclaimer, the term of this patent is extended or adjusted under 35 U.S.C. 154(b) by 48 days.

(21) Appl. No.: 15/247,496

(22) Filed: Aug. 25, 2016

(65) Prior Publication Data

US 2016/0361752 A1 Dec. 15, 2016

(51) Int. Cl.

| | |
|---|---|
| ***F27D 3/00*** | (2006.01) |
| ***F27D 99/00*** | (2010.01) |
| ***F27B 19/02*** | (2006.01) |
| ***B21J 19/02*** | (2006.01) |

(52) U.S. Cl.

CPC ..... *F27D 99/0033* (2013.01); *B21J 19/02* (2013.01); *F27B 19/02* (2013.01); *F27D 3/0024* (2013.01)

(58) Field of Classification Search

CPC ..... B21J 9/02; F27D 3/0024; F27D 99/0033; F27B 19/02

See application file for complete search history.

(56) References Cited

U.S. PATENT DOCUMENTS

| | | | | |
|---|---|---|---|---|
| 1,850,466 A * | 3/1932 | Martin | F24H 3/087 | 126/110 R |
| 3,960,093 A * | 6/1976 | Gregory | B21J 19/02 | 110/195 |
| 8,758,673 B2 * | 6/2014 | Al-Mutairi | F27D 99/0033 | 266/200 |

* cited by examiner

*Primary Examiner* — Scott R Kastler

(57) ABSTRACT

The embodiments herein provide a portable heat treatment machine comprising a forge body having a burn chamber surrounded by a housing, shell, or forge body. The openings are provided at the front side and at the back side of the forging body to move a forging material in and out of the burn chamber. The openings of the burn chamber and the forge body are covered with a sliding door. The sliding doors are opened to the desired degree to prevent a heat loss. A tab is provided to limit the movement of the sliding doors. Any desired off-shelf burner is inserted through a burner insert hole provided at the side of the forge body and is held and supported by a bracket attached to the forge body. Several legs are removably attached to the forge body to adjust the height of the body.

11 Claims, 4 Drawing Sheets

PORTABLE HEAT TREATMENT APPARATUS

BACKGROUND

Technical Field

The embodiments herein are generally related to a metal deforming machine. The embodiments herein are particularly related to a heat treatment machine. The embodiments herein are more particularly related to a portable heat treatment apparatus for heating metals for forging, casting, bending and manipulating metals.

Description of the Related Art

The heat treatment machines are used for pressure shaping of the metals and metal objects. The gas-fired heat treatment machines are used for heating and shaping a steel rod, a tube, a flat bar, an angle made of iron, a channel, a sheet and the like. The heat treatment machines are generally designed to heat either an object fully or indiscriminately a large area of it.

The conventional heat treatment machines occupy significant space and are cumbersome due to the shape and design. The storage of the conventional heat treatment machines is difficult and poses problems to those having limited space.

At present, forges with removable/adjustable legs are not available in the market. Further the burners are attached permanently to many of the forges thereby consuming space and the burners are also not easily removable.

The existing heat treatment machines do not offer/facilitate easy options for attaching a desired burner or detaching the burner for any other operations except heating the forge.

The size of the burn chamber in the current forges is also much larger than a requirement of many users. As a result, a large amount of fuel is wasted in heating up an interior space that is much larger than that required for the piece being heated. Specialized burners (often permanently attached) are required to heat the space and hence more heat is released into an outside environment, thereby making the outside environment uncomfortably hot for the user.

Further, the conventional heat treatment machines available in the market today have a preset orientation such as front/back or left/right orientations. As a result, the users have to compulsorily use the machines in the orientations decided or set by the manufactures. This may not always be the best suitable orientation for the end user based on the layout of the space being used.

Further, the conventional heat treatment machines do not have doors thereby allowing the heat from the burn chamber to escape to a room thereby generating a safety hazard to those who are present near to the heat treatment machine. As a result, more fuel than needed is burnt in the forge thereby increasing the cost and time of the user in replacing fuel bottles. Even the doors with the conventional designs present in the heat treatment machines, allow too much heat to escape. Further, the hinged door design in the conventional heat treatment machines requires a free hand to open the door, thereby inhibiting the user from using certain tools.

The doors of the conventional heat treatment machine are made of sheet metals. The doors made out of sheet metal act as a heat sink, which actually draws the heat from the forge, instead of keeping the heat inside the forge. In addition to the above, the metal sheet doors are warped from the heat to allow even more heat to escape through the cracks. The doors in the conventional heat treatment machine are also inclined to get seized up due to expansion and contraction in the repeated heating and cooling processes. As a result, the movement of the doors becomes difficult thereby yielding a potential safety hazard.

The conventional heat treatment machines do not have a burn chamber that is accessible from both the sides. Further, the conventional forges do not have very efficient doors. The poor door design consumes a lot of fuel, which increases the cost and time.

Further, the conventional heat treatment machines are not rugged and cannot handle much stress. This makes the current forges less durable. The conventional heat treatment machines have less durability, less efficiency, and single orientation.

Hence, there is a need for a heat treatment machine that is portable and occupies less space. Further, there is a need for a portable heat treatment machine that is more durable, more efficient, and has more than one orientation.

The above-mentioned shortcomings, disadvantages and problems are addressed herein and which will be understood by reading and studying the following specification.

OBJECTIVES OF THE EMBODIMENTS HEREIN

The primary objective of the embodiments herein is to provide a portable heat treatment machine with detachable legs.

Another objective of the embodiments herein is to provide a heat treatment machine that is operable using standard, off-the-shelf burners.

Yet another objective of the embodiments herein is to provide a heat treatment machine having sliding doors.

Yet another objective of the embodiments herein is to provide a heat treatment machine having dual orientations.

Yet another objective of the embodiments herein is to provide a heat treatment machine having a small footprint.

Yet another objective of the embodiments herein is to provide a portable heat treatment machine which is easily customized with respect to a user.

Yet another objective of the embodiments herein is to provide a heat treatment machine to enable a user to adjust or remove legs (bolts) or drill a larger burner hole or re-shape the burn chamber.

Yet another objective of the embodiments herein is to provide a portable heat treatment machine that is more durable and efficient.

Yet another objective of the embodiment herein is to provide a portable heat treatment machine that is easily assembled.

Yet another objective of the embodiment herein is to provide a portable heat treatment machine in which the legs are easily swapped with the legs desired by the user.

These and other objects and advantages of the embodiments herein will become readily apparent from the following detailed description taken in conjunction with the accompanying drawings.

SUMMARY

The embodiments herein provide a portable heat treatment machine. According to one embodiment herein, a portable heat treatment machine for forging the materials is provided. The heat treatment machine comprises a forge body. The forge body comprises a top plate and a bottom plate. A plurality of adjustable legs is attached to the bottom plate. A burn chamber is arranged inside the forge body for retaining a heat for achieving the desired temperature. A first opening and a second side opening are provided respectively at a front side wall and a back side wall of the forge body. The first opening and the second opening are provided for accessing the burn chamber. A third opening and a fourth opening are provided respectively at the front side wall and the back side wall of the forge body for insulation chamber for inserting the forging material into the burn chamber. A sliding door is provided at the front side and at the back side of the forge body for closing the openings of the burn chamber and insulation chamber. A plurality of door guide rails is arranged at the front side and at the back side of the forge body for forming a track for moving the sliding doors. A burner inlet hole is arranged at the side wall of the forge body for inserting a burner into the burn chamber. A burner support bracket is provided at the side of the forge body for holding and supporting the burner.

According to one embodiment herein, the top plate in the forge body is configured to protect an insulation at the top of the forge body and the bottom plate is configured to protect an insulation at the bottom of the forge body.

According to one embodiment herein, the plurality of adjustable legs are adapted to adjust the height of the forging body.

According to one embodiment herein, the plurality of adjustable legs include a plurality of leg nuts and a plurality of leg bolts. The plurality of leg nuts is configured to act as an anchor to the plurality of leg bolts. The plurality of leg bolts is configured to provide a standing structure. The plurality of leg bolts are secured to the forge body through the plurality of leg nuts.

According to one embodiment herein, the burn chamber is made of an insulating material. The burn chamber is surrounded and enclosed with the forge body. The forge body is formed with square tubing wrapped round the burn chamber.

According to one embodiment herein, the third opening and the fourth opening are provided adjacent to the first opening and the second opening respectively.

According to one embodiment herein, the sliding doors are configured to retain the heat generated in the burn chamber. The sliding doors are designed and configured to provide a suitable and required gap for moving a forging material in and out of the burn chamber. The plurality of sliding doors are made of an insulating material. The insulating material is a kiln brick material.

According to one embodiment herein, the door rails are attached to the forge body. The door rails are placed above and below the opening of the body chamber opening. The door rails are configured to cover the top and bottom edge of the plurality of sliding doors and keeps the plurality of sliding doors pressed to the forge body.

According to one embodiment herein, the plurality of door slide tabs are attached to the forge body. The plurality of door slide tabs are configured to prevent the plurality of sliding doors from falling off at the back edge of the forge body.

According to one embodiment herein, the burner inlet hole is cut into one side of the forge body and the insulation to accommodate the burner into the forge body.

According to one embodiment herein, the burner support bracket is configured to act as an anchor point and a standard tie is attached to the bracket to secure the burner to the forge body.

According to one embodiment herein, the heat treatment machine further comprises a plurality of door slide tabs arranged at the front side and the back side of the forge body. The plurality of door slide tabs are configured to act as a cradle for the movement of the plurality of sliding doors to access the opening to the burn chamber.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
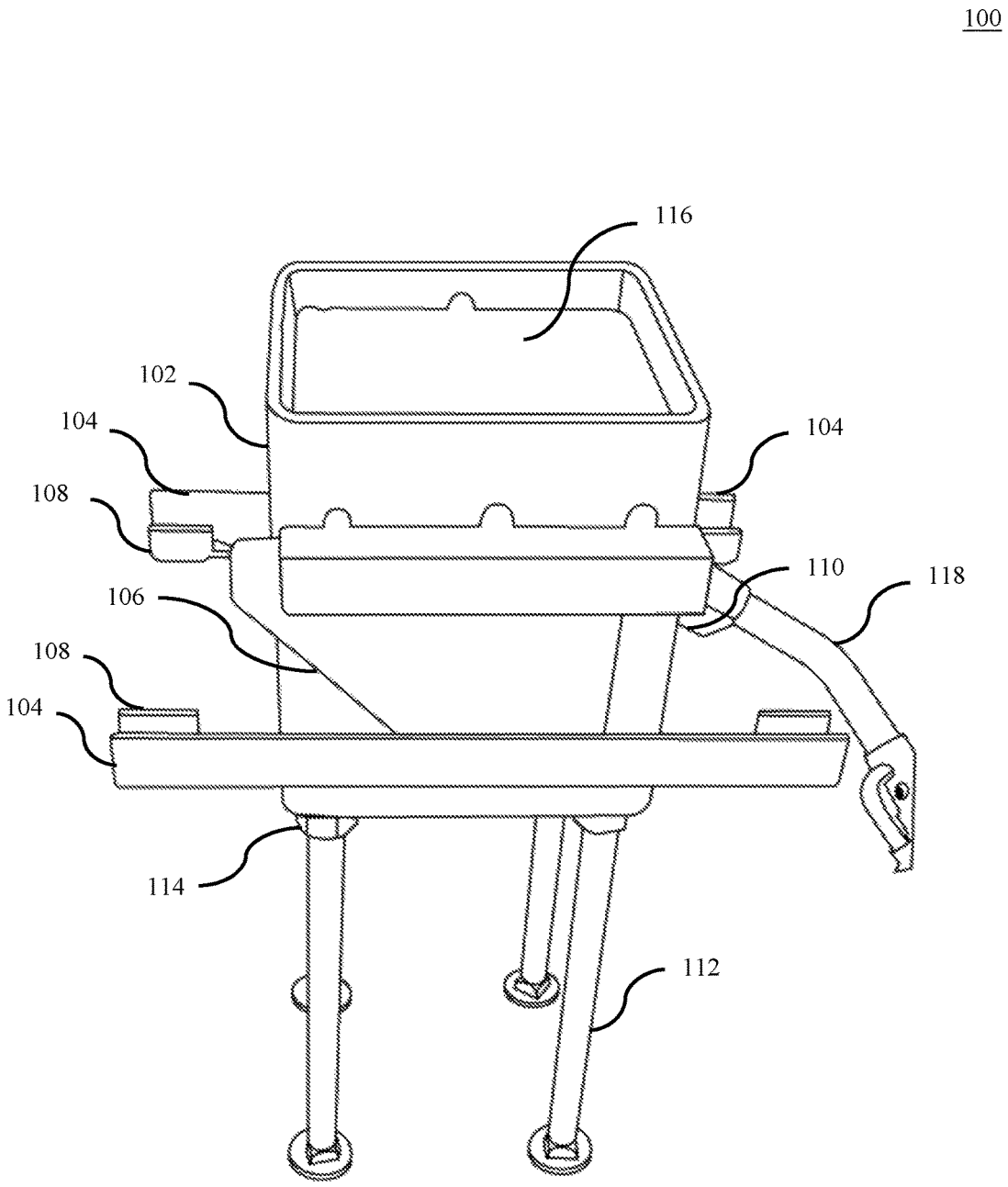
FIG. 1 illustrates a top side perspective view of a portable heat treatment machine, according to an embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE INVENTION

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein provide a portable heat treatment machine. According to one embodiment herein, a portable heat treatment machine for forging the materials is provided. The heat treatment machine comprises a forge body. The forge body comprises a top plate and a bottom plate. A plurality of adjustable legs is attached to the bottom plate. A burn chamber is arranged inside the forge body for retaining heat for achieving the desired temperature. A first opening and a second side opening are provided respectively at a front side wall and a back side wall of the forge body. The first opening and the second opening are provided for accessing the burn chamber. A third opening and a fourth opening are provided respectively on an insulation at the front side wall and the back side wall of the forge body for inserting the forging material into the burn chamber. A sliding door is provided at the front side and at the back side of the forge body for closing the openings of the burn chamber and burn chamber. A plurality of door guide rails is arranged at the front side and at the back side of the forge body for forming a track for moving the sliding doors. A burner inlet hole is arranged at the side wall of the forge body for inserting a burner into the burn chamber. A burner support bracket is provided at the side of the forge body for holding and supporting the burner.

According to one embodiment herein, the top plate in the forge body is configured to protect an insulation at the top of the forge body and the bottom plate is configured to protect an insulation at the bottom of the forge body.

According to one embodiment herein, the plurality of adjustable legs are adapted to adjust a height of the forging body.

According to one embodiment herein, the plurality of adjustable legs include a plurality of leg nuts and a plurality of leg bolts. The plurality of leg nuts is configured to act as an anchor to the plurality of leg bolts. The plurality of leg bolts is configured to provide a standing structure. The plurality of leg bolts are secured to the forge body through the plurality of leg nuts.

According to one embodiment herein, the burn chamber is made of an insulating material. The burn chamber is surrounded and enclosed with the forge body. The insulation forge body is formed with a square tubing wrapped round the burn chamber.

According to one embodiment herein, the third opening and the fourth opening are provided adjacent to the first opening and the second opening respectively.

According to one embodiment herein, the sliding doors are configured to retain the heat generated in the burn chamber. The sliding doors are designed and configured to provide a suitable and required gap for moving a forging material in and out of the burn chamber. The plurality of sliding doors are made of an insulating material. The insulating material is a kiln brick material.

According to one embodiment herein, the door rails are attached to the forge body. The door rails are placed above and below the opening of the body chamber opening. The door rails are configured to cover the top and bottom edge of the plurality of sliding doors and keeps the plurality of sliding doors pressed to the forge body.

According to one embodiment herein, the plurality of door slide tabs are attached to the forge body. The plurality of door slide tabs are configured to prevent the plurality of sliding doors from falling off at the back edge of the forge body.

According to one embodiment herein, the burner inlet hole is cut into one side of the forge body and the insulation to accommodate the burner into the forge body.

According to one embodiment herein, the burner support bracket is configured to act as an anchor point and a standard tie is attached to the bracket to secure the burner to the forge body.

According to one embodiment herein, the heat treatment machine further comprises a plurality of door slide tabs arranged at the front side and the back side of the forge body. The plurality of door slide tabs are configured to act as a cradle for the movement of the plurality of sliding doors to access the opening to the burn chamber.

The embodiments herein provide a portable heat treatment machine. According to one embodiment herein, the portable heat treatment machine comprises a forge body comprising a top plate, a bottom plate, a plurality of adjustable legs comprising a plurality of leg nuts, a plurality of leg bolts, a burn chamber, an opening for burn chamber, an insulation, an opening for insulation chamber, a body chamber, a plurality of sliding doors, a plurality of door rails, a plurality of door slide tabs, a burner inlet hole, and a burner support bracket.

According to an embodiment herein, the forge body is used for holding an insulation, and acting as a platform for connecting a plurality of components of the heat treatment machine.

According to an embodiment herein the forge body includes a top plate for protecting the insulation at the top of the forge body and a bottom plate for protecting the insulation at the bottom of the forge body.

According to an embodiment herein, the top plate is in conjunction with the forge body and the bottom plate is in conjunction with the forge body, and the bottom plate protects the insulation at the bottom of the forge body.

According to an embodiment herein, the bottom plate further comprises a mechanism to attach a plurality of legs of the heat treatment machine. According to an embodiment herein, the plurality of adjustable legs attached to the bottom plate. The plurality of adjustable legs are used for adjusting the height of the heat treatment machine. The mechanism includes a plurality of leg nuts and a plurality of bolts. The plurality of leg nuts are used for attaching legs of the heat treatment machine. The plurality of leg nuts acts as an anchor to a plurality of leg bolts.

According to an embodiment herein, a plurality of leg bolts are used for providing a stand/support structure to the heat treatment machine, and the plurality of leg bolts are secured to the forge body through the plurality of leg nuts.

According to an embodiment herein, the burn chamber is used for retaining the heat inside the forge body for achieving a desired temperature, and the burn chamber is covered with an insulating material.

According to an embodiment herein, the opening for the body chamber is provided on the two opposite sides of the burn chamber. The openings for the burn chamber are respectively provided on the two opposite walls of the chamber. The openings for the burn chamber are covered respectively with a sliding door having an angled plate. The opening for the body chamber/burn chamber provides an access to the burn chamber.

According to an embodiment herein, the opening for insulation chamber is configured to insert the forging material into the burn chamber.

According to an embodiment herein, the plurality of sliding doors are used for closing the openings of the burn chamber.

According to an embodiment herein, the plurality of door rails are used for creating a track or the guiding rails for the plurality of sliding doors to slide-in.

According to an embodiment herein, the plurality of door slide tabs acts as a cradle for the plurality of sliding doors during the slide movement to access an opening to the burn chamber.

According to an embodiment herein, the burner inlet hole acts as an inlet for a burner. The burner inlet hole is provided at one side wall of the burn chamber. The burner is inserted through the holes at the wall arranged at right angles to the wall provided with the opening for the burn chamber.

According to an embodiment herein, the burner support bracket is adapted to support the burner. The burner support bracket is provided outside the burn chamber on the forge body.

According to an embodiment herein, the plurality of adjustable legs include a plurality of leg nuts and a plurality of leg bolts. The plurality of leg nuts acts as an anchor to the plurality of leg bolts and the plurality of leg bolts provide a stand/support structure. According to an embodiment herein, the plurality of leg bolts are secured to the forge body through the plurality of leg nuts.

According to an embodiment herein, the burn chamber is made of an insulating material.

According to an embodiment herein, the opening for the body chamber is a hole cut into the forge body and the opening for the body chamber has an option for providing filing.

According to an embodiment herein, the opening for the insulation chamber is a hole cut into the insulation at the front end and at the rear end of the forge body.

According to an embodiment herein, the sliding doors are arranged to retain the heat generated in the burn chamber. The sliding doors are designed and configured to allow or provide enough gap for the forging material to slide in and out of the burn chamber. According to an embodiment herein, the plurality of sliding doors are made of an insulating material.

According to an embodiment herein, the door rails are attached to the forge body and placed above and below the opening of the body chamber. The door rails cover the top and bottom edge of the plurality of sliding doors and keep the plurality of sliding doors pressed to the forge body.

According to an embodiment herein, the plurality of door slide tabs are attached to the forge body and the plurality of door slide tabs prevent the plurality of sliding doors from falling out at the back edge of the forge body. The tabs act as a mechanical stopper for inhibiting the movement of the sliding doors.

According to an embodiment herein, the burner inlet hole is cut into one side of the forge body and the insulation chamber. The burner inlet hole is designed and configured to allow the user to drill the insulation hole larger to accommodate the burner into the forge body.

According to an embodiment herein, the burner support bracket acts as an anchor point to which a standard tie is provided to secure the burner to the forge body.

According to an embodiment herein, the sliding doors are operated in dual directions. According to an embodiment herein, the sliding doors are opened only up to the requirement degree.

According to an embodiment herein, the sliding doors are moved till the required point or a required opening is achieved for removing the forging material, during a removal of the forging material from the burn chamber after the forging operation is completed.

According to an embodiment herein, the plurality of adjustable legs are attached to the forge body by fastening the leg nuts and leg bolts to the bottom plate of the forge body.

According to an embodiment herein, the plurality of leg nuts are attached to a forge body.

According to an embodiment herein, the user is provided with an option to decide the direction of movement of the sliding door. According to an embodiment herein, the sliding doors are operable in dual directions or bi-directions.

According to an embodiment herein, the sliding doors are opened only up to the requirement degree or point.

According to an embodiment herein, the plurality of sliding doors are used for closing off the openings of the burn chamber. According to an embodiment herein, the sliding doors retains the heat generated in the burn chamber, and the plurality of sliding doors allows enough gap for the forging material to slide in and out of the burn chamber, and the plurality of sliding doors are made of an insulating material.

According to an embodiment herein, the plurality of door slides are used for creating a track for the plurality of sliding doors to slide, and the door slides are attached to the forge body and placed above and below the body chamber opening. According to an embodiment herein, the plurality of door slides covers the top and bottom edge of the plurality of sliding doors and keeps the plurality of sliding doors pressed to the forge body.

According to an embodiment herein, the plurality of door slide tabs act as a cradle for the plurality of sliding doors during the slide to provide an opening to the burn chamber and the plurality of door slide tabs prevents the plurality of sliding doors from falling off the back edge.

According to an embodiment herein, the burner inlet hole acts as an inlet for a burner, and the burner inlet hole is cut into one side of the forge body and the insulation, and the burner inlet hole allows the user to drill the insulation hole larger to accommodate the burner into the forge body.

According to an embodiment herein, the burner support bracket is used for supporting the burner, and the burner support bracket acts an anchor point to which an appropriate tie provided to secure the burner to the heat treatment machine.

The embodiments herein provide a portable heat treatment machine. The portable heat treatment machine comprises a forge body, a top plate, a bottom plate, a plurality of leg nuts, a plurality of leg bolts, a burn chamber, a burn chamber opening, an insulation, a body chamber, a plurality of sliding doors, a plurality of door slide tabs, a burner inlet hole, and a burner support bracket.

The various embodiments herein provide a portable heat treatment machine. The heat treatment machine is used for manipulating (forging, casting, bending, and the like) materials such as small amount of metals. According to an embodiment herein, the heat treatment machine comprises a burn chamber housed inside the body of the heat treatment machine and allows a user to pass the metal that has to be manipulated. The heat treatment machine uses off-the-shelf burners that are easily fixed and removed from the body of the heat treatment machine. According to an embodiment herein, the design of the heat treatment machine is compatible with the standard plumber torch.

According to an embodiment herein, the heat treatment machine comprises sliding doors at the front and back, to retain the heat produced. The heat retained produces maximum efficiency. Further, the sliding doors are angled such that the small material is inserted into the forge without a need to open the sliding doors fully and losing heat. The front and rear sliding doors of the forge mirror each other so that the forge is used in either direction. According to an embodiment herein, the design allows the burner to position on the right or left side of the heat treatment machine giving the user more choice in the orientation of the forge. The adjustable legs of the heat treatment machine comprises bolts, which are replaced with various lengths of legs to suit the user needs.

Figure 2:
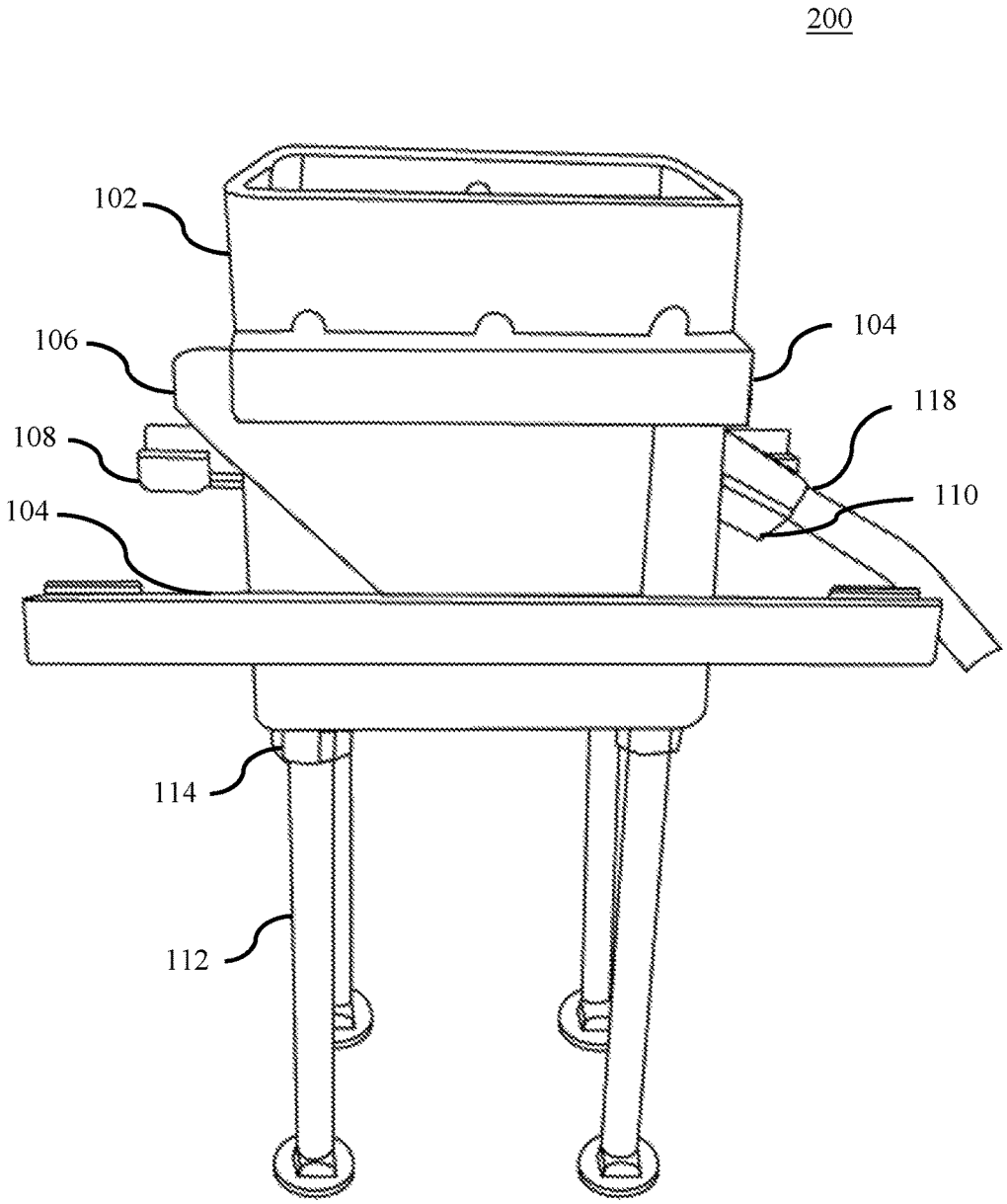
FIG. 2 illustrates a front view of a portable heat treatment machine with sliding doors in a closed condition, according to an embodiment herein.
Figure 3:
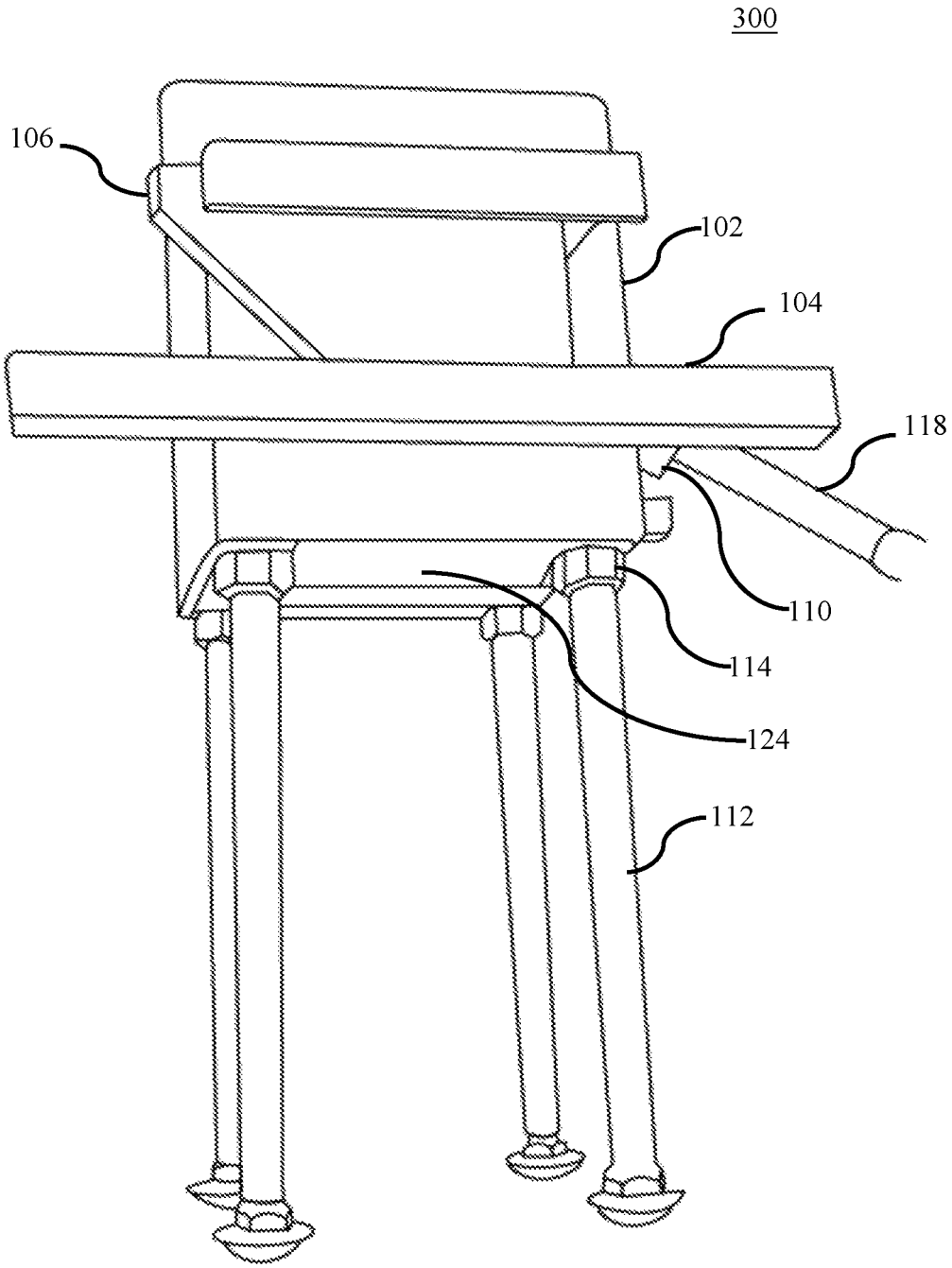
FIG. 3 illustrates a bottom side perspective view of a portable heat treatment machine, according an embodiment herein.
Figure 4:
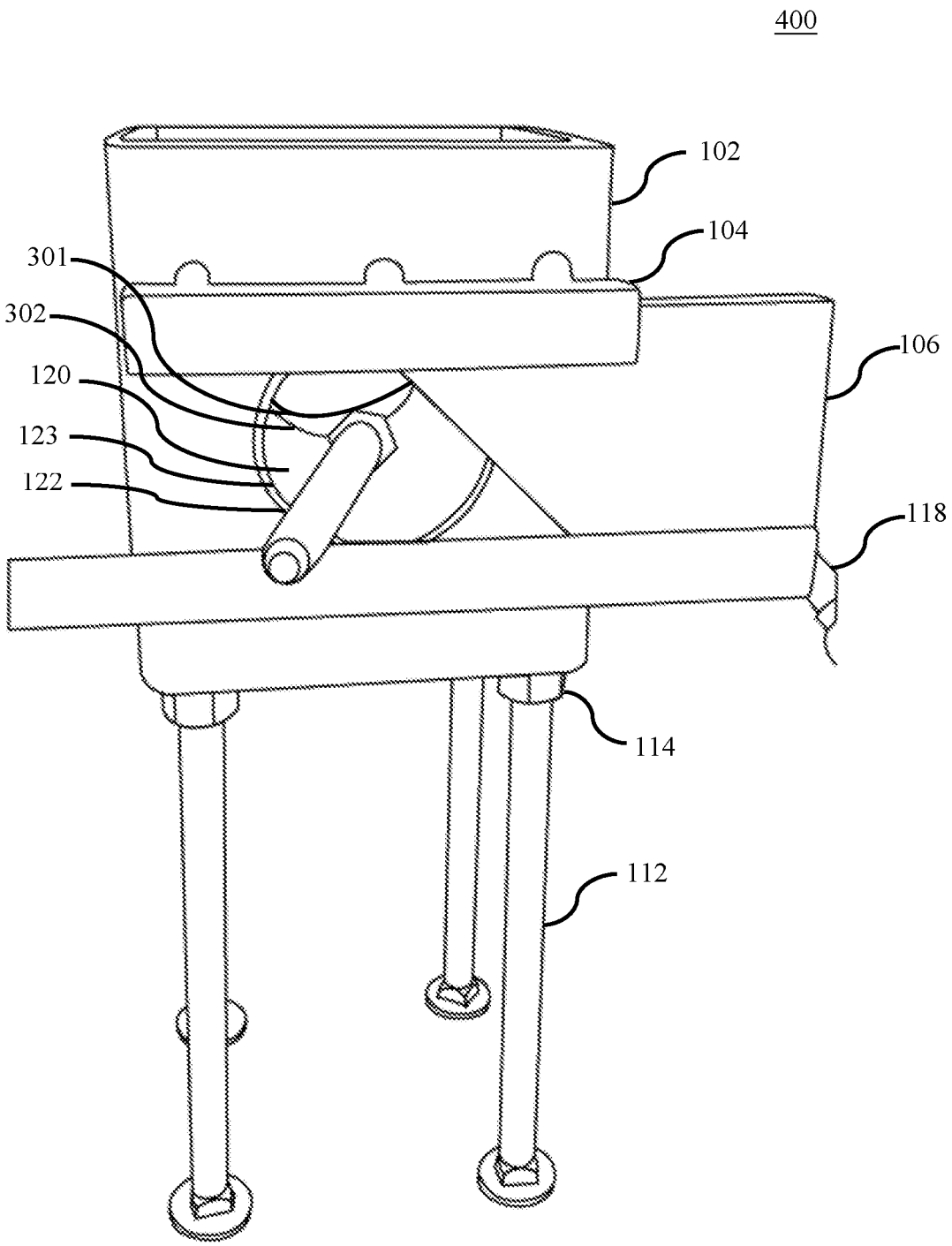
FIG. 4 illustrates a front view of a portable heat treatment machine with sliding doors at both the sides in a fully opened condition, according to an embodiment herein.

FIG. 1 illustrates a top side perspective view of a portable heat treatment machine, while the FIG. 2 illustrates a front side of the potable heat treatment machine with doors in closed condition and the FIG. 3 illustrates a bottom side perspective view of the potable heat treatment machine with doors in fully closed condition, according to an embodiment herein. FIG. 4 illustrates a front view of a portable heat treatment machine with sliding doors at both the sides in a fully opened condition, according to an embodiment herein.

With respect to FIG. 1-FIG. 4, the portable heat treatment machine includes the forge body 102, the rails 104, the top plate 116, the sliding door 106, the door slide tabs 108, the burner support bracket 110, the leg bolts 114, the leg nuts 112, the burner 118, the opening for body chamber 120, and the burn chamber opening 122, 301. Further, the portable heat treatment machine includes a bottom plate 124.

According to an embodiment herein, the forge body 102 is made of durable material such as steel. The forge body 102 includes the top plate 116 and the bottom plate 124. The top plate 116 and the bottom plate 124 are attached to the forge body to provide insulation cover to the burn chamber. According to an embodiment herein, the forge body 102 has a square tubing. The forge body 102 is in conjunction with the top plate 116 and the bottom plate 124 of the forge body 102. According to an embodiment herein, the forge body 102 contains an insulation such as a firebrick that protects the forge body 102 from damage. Further, the forge body 102 acts as a platform in which all the other components of the heat treatment machine 100 are attached.

According to an embodiment herein, the top plate 116 is made of material such as steel sheet. The top plate 116 protects the insulation at the top of the heat treatment machine.

According to an embodiment herein, the heat treatment machine 100 includes two sliding doors 106, arranged on either side of the forge body 102. According to an embodiment herein, the sliding doors 106 are made of insulating materials such as firebrick. The sliding doors 106 are used for closing the openings of the burn chamber 122, 301. According to an embodiment herein, the sliding doors 106 are configured and arranged to retain the heat generated from the burner 118 inside the heat treatment machine. Further, the sliding doors 106 are designed and configured to allow/provide enough gap for the forging material to slide in and out safely with ease.

According to an embodiment herein, the plurality of door rails 104 are made of durable material such as steel. According to an embodiment herein, the plurality of door rails 104 is attached at an angle. The plurality of door rails 104 are attached to the forge body 102 both above and below the opening of the body chamber 120 at the proper distance to create a track/guide rail for the slidable movement of plurality of sliding doors 106. The plurality of door rails 104 covers the top and bottom edge of the plurality of sliding doors 106 to avoid the plurality of sliding doors 106 from falling down. The tab acts as a mechanical stopper to limit and arrest the movement of the doors beyond a limit. Further, the plurality of door rails 104 keep the plurality of sliding doors 106 pressed close to the forge body 102 to provide enough heat inside the burn chamber 120.

According to an embodiment herein, the top door slide is shorter than the lower door slide/rail. This is because the angle at which the sliding door is cut negates the need for a longer slide at the top. According to an embodiment herein, the plurality of door rails 104 does not cover the entire length of the back of the plurality of sliding doors 106. According to an embodiment herein, an option is provided for including an elongated door rail into the forge body 102 without any gain or loss in the functionality.

According to an embodiment herein, the plurality of door slide tabs 108 are used for holding the plurality of door rails 104 and the sliding door 106. According to an embodiment herein, the door slide tabs 108 are made of material such as steel. According to an embodiment herein, the door slide tabs 108 act as a cradle for the sliding doors 106. According to an embodiment herein, the sliding door 106 are slidably moved to open the burn chamber 120. The door slide tabs 108 avoids the sliding door 106 from falling off the back edge of the door slide.

With respect to FIG. 1, the door slide tabs 108 does not cover the entire length of the back of the door rails 104. According to an embodiment herein, an option is provided to include a longer door without any gain or loss in the functionality.

According to an embodiment herein, the leg bolts 112 are detachable leg bolts. The user assembles the heat treatment machine by attaching the leg nuts 112 to the forge body 102. According to an embodiment herein, the leg bolts 112 are made of non-rusting material such as steel. The leg nuts 114 act as an anchor for the leg bolts 112.

According to an embodiment herein, the leg bolts 112 are the metal bolts made of material such as steel or iron. The leg bolts 112 are fastened to the leg nuts 114. According to an embodiment herein, the additional secondary leg nuts are used for securing the leg bolts 112 in place to the forge body 102. The leg nuts 114 and the leg bolts 112 constitute the adjustable legs of the heat treatment machine and are removable. According to an embodiment herein, the user attaches the adjustable legs during the use of the heat treatment machine 100 and detaches the adjustable legs after the completion of forging action.

According to an embodiment herein, the opening of the body chamber opening 122 is a hole cut into the forge body 102. According to an embodiment herein, the opening of the body chamber 122 is present both in the front and the back of the heat treatment machine. The opening of the body chamber 122 allows the user to access the burn chamber 120. The size of the opening of the body chamber is larger than that of the opening for insulation chamber. According to an embodiment herein, the opening of the body chamber opening 122 does not act as heat sink for sucking away the heat from the burn chamber 122 as being too close. According to an embodiment herein, the body chamber opening allows the user to file the burn chamber opening 122 and make the burn chamber 120 larger, when the user wishes to have a larger burn chamber without having to cut the forge body 102.

According to an embodiment herein, the heat treatment machine includes a burner inlet hole. The burner inlet hole is cut into one side of the forge body 102 and acts as an inlet for the burner 118. According to an embodiment herein, the burner inlet hole is made of durable material such as steel. The size of the burner inlet hole is larger than that of the insulation hole for allowing the user to easily drill the insulation hole larger to accommodate the off-the-shelf burner 118.

According to an embodiment herein, the burner support bracket 110 is laid/arranged/mounted on the top of the forging material, while the burner 118 is slid into the burner inlet hole 120. According to an embodiment herein, the burner support bracket 110 is designed to support the burner 118 and acts as an anchor point at which an appropriate tie is used for securing the burner into the heat treatment machine 100. According to an embodiment herein, the burner support bracket 110 is made of material such as steel.

According to an embodiment herein, the burner 118 is used as the heat source for the heat treatment machine 100. According to an embodiment herein, the burner 118 is not included as the part of the heat treatment machine 100. The user chooses any of the standard off-the-shelf burner to forge the material or the user is allowed or enabled to create a customized burner and attach the same as the user feels fit.

According to an embodiment herein, the burn chamber opening 122, 301 is a hole cut into the forge body 102 both at the front end and at the back of the heat treatment machine. The burn chamber opening 122, 301 is provided at the beginning and at the end of the burn chamber 120.

According to an embodiment herein, the removable legs make the storage and the transport of the heat treatment machine 100 very convenient, as the forge machine is small and portable. According to an embodiment herein, the user is allowed to swap out the adjustable legs of the heat treatment machine and choose the desired one with ease.

According to an embodiment herein, the cube shape of the burning chamber 120 is convenient for the users having welding skill set to attach brackets of the burner 118, fuel sources, and the like.

According to an embodiment herein, the design of burn chamber 120 makes the heat treatment machine more fuel efficient, which is critical when using small fuel sources like plumber's torch. According to an embodiment herein, the burn chamber 120 has the space to heat materials of various thickness such as ½", ¾", 1", and the like. The thickness of the material accommodated by the burn chamber 120 of the heat treatment machine 100 is sufficient to meet the market needs of varied professionals such as hobbyists, crafters, children, handymen, knife makers, jewelers, machinists, blacksmiths, metal workers, artists, and the like.

Further, according to an embodiment herein, the burnet inlet hole is located on the steel body of the heat treatment machine. The burner inlet hole has a size larger than that of the burner inlet hole provided in the insulation chamber, thereby giving the user with an option to easily customize the hole size to meet the needs/requirements of the burner, without requiring the user to drill or cut the forge body 102. Similarly, the same is implemented/repeated for the burn chamber opening 122, 301 also thereby allowing the user to easily modify the hole in the burn chamber opening by performing a filing process.

According to an embodiment herein, the design of the heat treatment machine 100 is same/similar at the back side and the front side. The same design at the back and front sides of the heat treatment machine 100 allows the user to spin the heat treatment machine 100, when desired. According to an embodiment herein, the fuel sources are inserted either on the left side or on the right side, based on a requirement of the user.

According to an embodiment herein, the sliding doors 106 are cut at an angle to allow/reduce a heat loss during the opening of the doors, thereby increasing or improving the efficiency of the heat treatment machine 100. According to an embodiment herein, the door slides 108 hold the sliding doors 106 in an extended condition beyond the forge body 102 thereby allowing the sliding doors 106 to move to the sides in both directions without falling off, and providing more safety to the heat treatment machine 100.

According to an embodiment herein, the sliding action of the sliding doors 106 along with the angled cut allows the user to open the sliding door sufficient enough to insert the material to be worked/forged. The sliding doors 106 and the angled cut on the forge body 102 maximizes the heat retaining capabilities of the heat treatment machine 100. Further, the user also has a freedom to choose the direction of movement of the sliding door based on user convenience in certain situations. According to an embodiment herein, the sliding door 106 is easily opened using the material to be forged or the tongs used for holding the material, which allows the user to perform other tasks instead of opening the door.

According to an embodiment herein, the front side of the heat treatment machine 100 mirrors the backside, i.e., the openings 122, 301 are provided both at the front side and backside of the forge body 102, to access the burn chamber 120 in the forge body 102 and to pass a forging material through the burn chamber in the heat treatment machine. Further, the design of the heat treatment machine 100 allows the user to insert an oversized material through the opening at one side of the forge body 102 and to remove the oversized material from the opening at the another side of the heat treatment machine, thereby simplifying the operation of the heat treatment machine and increasing the efficiency of the heat treatment machine.

According to an embodiment herein, the heat treatment machine 100 is constructed using one piece of steel tubing and using fire brick instead of soft blanket or boars. According to an embodiment herein, the tubing holds the cracked bricks and continues to function without any loss in performance, even when the firebrick of the heat treatment machine 100 develops cracks or gets damaged. According to an embodiment herein, the square shape of the heat treatment machine 100 design along with the thickness of the steel tube walls give the user a lot of material to work when the user decides to make a plurality of modifications.

With respect to FIG. 4, the first opening 122 and the second opening 301 provided respectively at the front side and at the back side are kept opened to allow the user to pass the forging material through the burn chamber. A forging material is inserted into the burn chamber through the first opening at the front side and removed out through the second opening at the rear side. The third opening 123 and the fourth opening 302 are provided respectively at the front side wall and the back side wall of the forge body for insulation chamber for inserting the forging material into the burn chamber.

According to an embodiment herein, the burner inlet is provided on the side of the forge body. This keeps the heat away from the fuel source for safety.

According to an embodiment herein, the doors of the heat treatment machine are made of kiln bricks that does not wrap or get excessively hot. Further, the sliding doors are cut on an angle to reduce heat loss during the opening of the doors. The angle cut on the sliding door makes the design of the heat treatment machine more efficient.

According to an embodiment herein, the burn chamber along with the sliding door design keeps the heat inside the forge body to increase efficiency.

According to an embodiment herein, the user of the heat treatment machine is not wedded to a specific burner. The user is able to use an off-the-shelf burner thereby giving the user greater flexibility and freedom to use one burner for multiple operations or make a separate customized burner when required.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A portable heat treatment machine comprising:

a forge body, wherein the forge body comprises a top plate and a bottom plate;

a plurality of adjustable legs attached to the bottom plate;

a burn chamber arranged inside the forge body for retaining heat for achieving a desired temperature;

a first opening and a second opening provided respectively at a front side wall and a back side wall of the forge body, wherein the first opening and the second opening are provided for accessing the burn chamber;

a third opening and a fourth opening provided respectively at the front side wall and the back side wall of the forge body for inserting a forging material into the burn chamber, and wherein the third opening and the fourth opening are provided adjacent to the first opening and the second opening respectively;

a sliding door provided before the front side wall and the back side wall of the forge body for closing the first opening and the second opening;

a plurality of door guide rails arranged at the front side wall and at the back side wall of the forge body for forming a track for moving the sliding doors;

a burner inlet hole for inserting a burner into the burn chamber; and a burner support bracket for holding and supporting the burner.

2. The heat treatment machine according to claim 1, wherein the top plate in the forge body is configured for protecting an insulation at a top of the forge body and wherein the bottom plate is configured for protecting an insulation at a bottom of the forge body.

3. The heat treatment machine according to claim 1, wherein the plurality of adjustable legs are adopted to adjust a height of the forging body, and wherein the plurality of adjustable legs are replaced with legs of various length to suit a need of a user.

4. The heat treatment machine according to claim 1, wherein the plurality of adjustable legs include a plurality of leg nuts and a plurality of leg bolts, and wherein the plurality of leg nuts is configured to act as an anchor to the plurality of leg bolts, and wherein the plurality of leg bolts is configured to provide a stand or support structure, and wherein the plurality of leg bolts are secured to the forge body through the plurality of leg nuts.

5. The heat treatment machine according to claim 1, wherein the burn chamber is made of an insulating material, and wherein the burn chamber is surrounded and enclosed by the forge body.

6. The heat treatment machine according to claim 1, wherein the sliding doors are configured to retain the heat generated in the burn chamber, and wherein the sliding doors are designed and configured to provide a suitable and required gap for moving the forging material in and out of the burn chamber, and wherein the plurality of sliding doors are made of an insulating material and wherein the insulating material is kiln brick material, and wherein the sliding doors are angled such that the material is inserted without opening the sliding doors fully and losing heat.

7. The heat treatment machine according to claim 1, wherein the plurality of door guide rails are attached to the forge body, and wherein the plurality of door guide rails are placed above and below the first opening and the second opening, and wherein the plurality of door guide rails are configured to cover a top edge and a bottom edge of the plurality of sliding doors and wherein the plurality of door guide rails is configured to keep the plurality of sliding doors pressed to the forge body.

8. The heat treatment machine according to claim 1, wherein a plurality of door slide tabs are attached to the forge body, and wherein the plurality of door slide tabs are configured to prevent the plurality of sliding doors from falling off a back edge of the forge body.

9. The heat treatment machine according to claim 1, wherein the burner inlet hole is cut into one side of the forge body and an insulation to accommodate the burner into the forge body.

10. The heat treatment machine according to claim 1, wherein the burner support bracket is configured to act as an anchor point and wherein a tie is attached to the bracket to secure the burner to the forge body.

11. The heat treatment machine according to claim 8, wherein the plurality of door slide tabs are arranged at the front side wall and the back side wall of the forge body, wherein the plurality of door slide tabs are configured to act as a cradle for a movement of the plurality of sliding doors to access the first opening and the second opening to the burn chamber.

* * * * *